United States Patent [19]

Gonzales

[11] 4,158,892

[45] Jun. 26, 1979

[54] SLEEPING BAG, JUMPSUIT JACKET, AND VEST

[76] Inventor: John A. Gonzales, 413 Yosemite Ave., Modesto, Calif. 95351

[21] Appl. No.: 804,577

[22] Filed: May 31, 1977

[51] Int. Cl.[2] ..... A41D 15/04

[52] U.S. Cl. ..... 2/69.5; 2/79; 2/84; 2/93; 5/413

[58] Field of Search ..... 2/69, 69.5, 79, 84, 2/DIG. 7, 114, 93; 5/343

[56] References Cited

U.S. PATENT DOCUMENTS

| | | | |
|---|---|---|---|
| 33,752 | 11/1861 | Phillips | 5/343 X |
| 1,489,046 | 4/1924 | Thompson | 2/DIG. 7 |
| 2,372,110 | 3/1945 | Noone | 5/343 X |
| 2,624,048 | 1/1953 | Kovary | 2/69.5 |
| 2,911,648 | 11/1959 | Schanda-Seyferth | 2/69 |
| 2,971,205 | 2/1961 | Shultz | 2/69.5 X |
| 3,381,306 | 5/1968 | Innes | 2/69 |
| 3,924,273 | 12/1975 | Donovan | 2/69.5 |

*Primary Examiner*—R. Hampton Hunter

[57] ABSTRACT

A sleeping bag convertible into different garments; and which includes front and rear panels that can be zipped together in variable ways, and the device additionally including a pair of foot warmers, a pair of gloves and a belt.

1 Claim, 6 Drawing Figures

SLEEPING BAG, JUMPSUIT JACKET, AND VEST

This invention relates generally to convertible garments.

A principle object of the present invention is to provide an article that can be readily and easily converted into either a sleeping bag, jump-suit, jacket or vest.

Another object is to provide a convertible article, wherein the sleeping bag, jump-suit and jacket all include an adjustable hood.

Still another object is to provide a convertible article, which will lighten a load carried by back-packers out of doors, by having the single article to serve the purpose of several.

Still a further object is to provide a convertible article, which may be made in different sizes, of different materials and fillings, so as to meet various requirements in a wilderness, as well as a purchaser's pocketbook.

Still a further object is to provide a convertible article, in which a lower section can be coverted, either into a bottom half of a sleeping bag, or convertible into legs of a jump-suit, or convertible into a vest, that can be worn either separately, or inside the jacket.

Other objects are to provide a convertible article, which is simple in design, inexpensive to manufacture, rugged in construction, easy to use and efficient in operation.

These and other objects will be readily evident upon a study of the following specification and accompanying drawings wherein.

Figures 1, 2, 3, 4, 5:
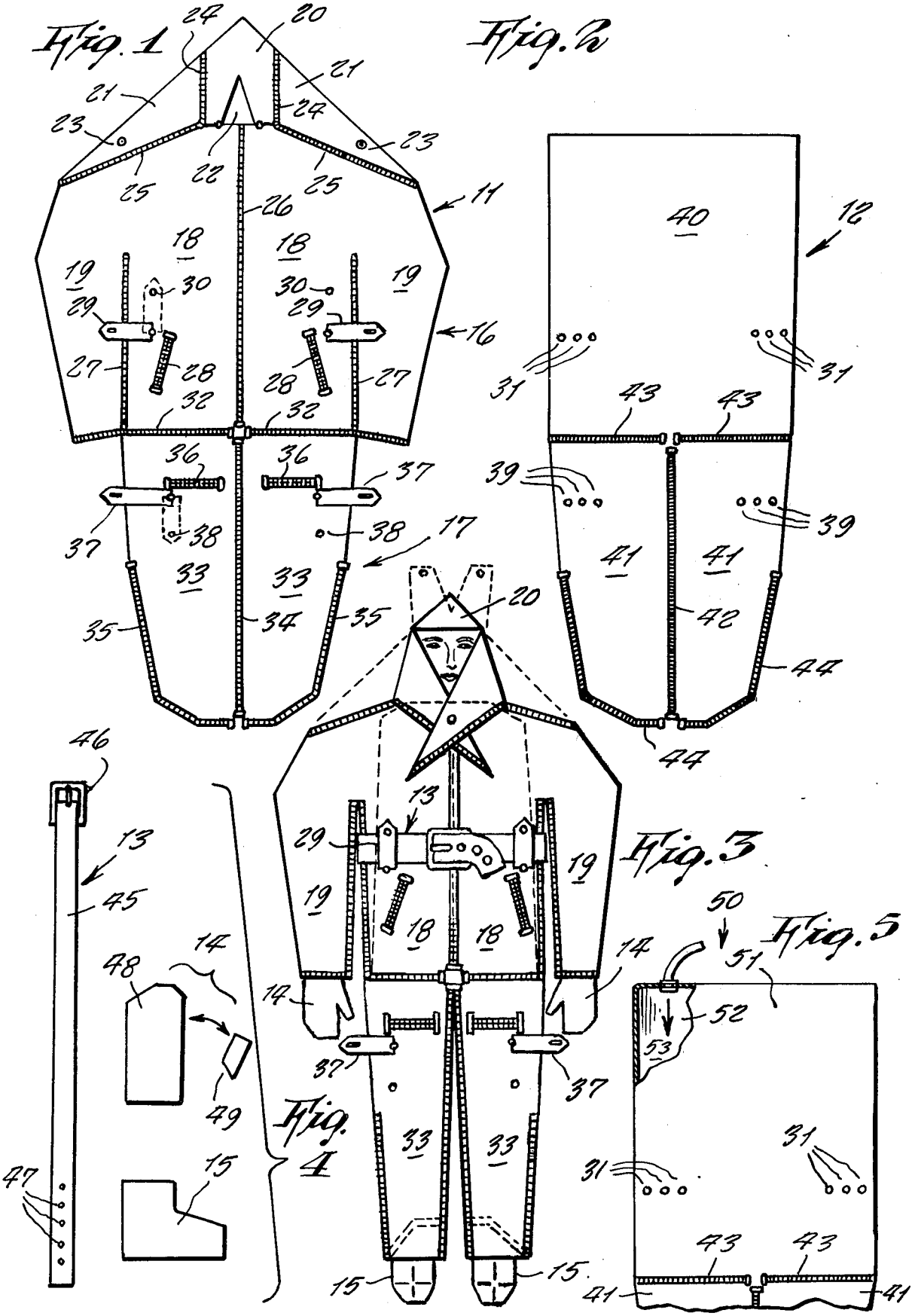
FIG. 1 is a front elevation view of the device, shown opened out, so as to form a sleeping bag.
FIG. 2 is a rear side thereof.
FIG. 3 is a front view of the device, shown closed up, so as to form a hooded jump-suit, with gloves and foot warmers.
FIG. 4 is a view of auxiliary components including a belt, a glove with thumb, and one of the foot warmers.
FIG. 5 is a fragmentary view, showing a portion of the rear panel illustrated in FIG. 2, and including a modified design of the invention.

Referring now to the drawings in greater detail, the reference numeral 10 represents a convertible article, according to the present invention, which can be converted into either a sleeping bag, jump-suit, jacket or vest.

The article 10 is comprised of a front panel 11, shown in FIG. 1, and a rear panel 12, shown in FIG. 2, and additionally including a belt 13, a pair of gloves 14 and a pair of foot warmers 15, shown in FIG. 4.

The front panel 11 is shown to include an upper section 16, and a lower section 17, made of any desirable or suitable fabrices, or other material. The upper section 16 includes chest front sections 18, each of which is integral with a front side of a jacket arm 19, the upper end of the upper section 16 includes a hood 20, having front sides 21, as shown. A breathing notch 22 is provided on the hood. Two-way snaps 23 are provided on each of the front sides of the hood, as shown, and the hood front sides are attached to the hood by slide fasteners or zippers 24; the hood front sides being attached to the chest front sections, by means of zippers 25. A vertical mid-zipper 26 connects the left and right chest front sections together. A zipper 27 extends between the chest front sections and the front sides of the jacket arms. It is to be understood that each jacket arm 19 is permanently tubular, and the component of zipper 27, that is secured to each arm 19, is not for opening up this tubular construction, but serves merely to secure the tubular arm to the front section 18.

Pockets are provided on the chest front sections, the pockets being closeable by slide fasteners or zippers 28. A swivel strap 29 is pivotally attached to each chest front section, and which is pivotable between the two different positions, indicated by the solid and dotted lines, so as to serve either as a belt loop, or for the purpose of gathering the material for purposes of a snug fit. When used as a belt loop, the swivel strap hooks onto button 30. When used for gathering material for purpose of a snug fit, the swivel straps engage, selectively, buttons 31 on the rear panel 12. The zipper 27 are unzipped when the swivel straps 29 are used to engage buttons 31 on the rear panel, or when the belt 13 is used around a wearer's torso, as shown in FIG. 3.

The upper section 16 and lower section 17 are attached together by means of zippers 32, between each chest front section 18 and a leg front section 33 on the lower section. A mid-zipper 34 connects the leg front sections together. The zipper 34 is of two-way adjustable type, the outer side edges of the leg front sections each has a two-way adjustable zipper 35. It is to be noted that the two-way adjustable zippers 34 and 35, each can zip open, shut, and lock into position, making it possible to adjust to proper fit when converted.

Each leg front section 33 is provided with a pouch or pocket, that is closeable by zipper 36, the pocket of which serves as a vest pocket, when the sleeping bag is converted into a vest. Each leg front section also includes a swivel strap 37, pivotable between the positions shown by the solid and dotted lines in FIG. 1. When the swivel strap is used as a belt loop for a vest, it is then attached to the button 38. When the swivel strap is used to gather material for a snug fit, each swivel strap 37 engages, selectively, the buttons 39 on the rear panel 12.

The rear panel 12 includes an upper panel 40, and a pair of leg rear sections 41. The leg rear sections are attachable together, by means of zipper 42 therebetween, and the upper ends of the leg rear sections are attachable to a lower edge of the upper section 40 by means of zippers 43. Zippers 44, around the outer side edges of the leg rear sections 40, are provided for joinment with the zippers 35, on the leg front sections 33.

The belt 13 includes a strap 45, having a buckle 46 at one end, and a row of holes 47 at its other end.

Each slip-on glove 14 includes a hand mitten section 48, and a thumb section 49, that are stitched together. An elastic on the wrist band of the slip-on glove provides a snug fit for wear.

Each foot warmer 15 has an elastic band on the ankles, for purposes of a snug fit on a wearer's foot.

Figure 6:
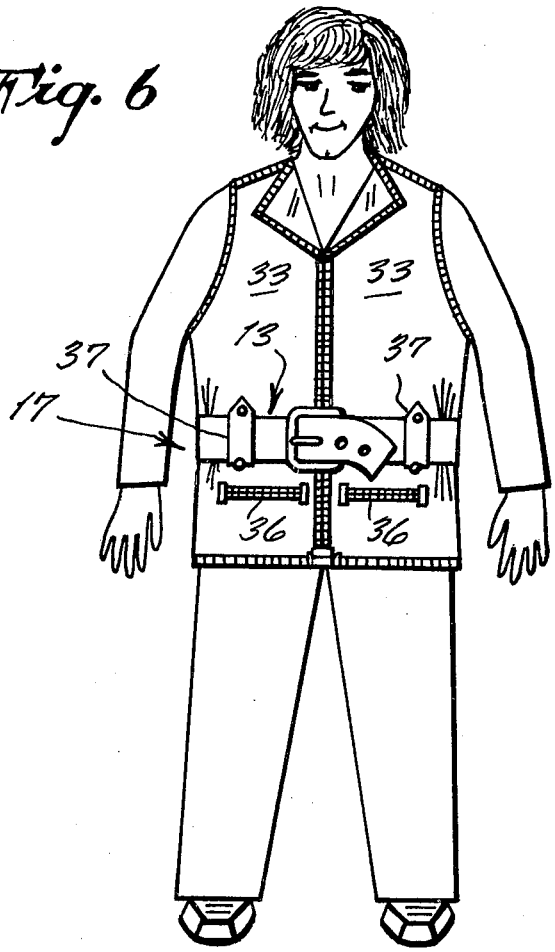
FIG. 6 is a front view showing an example of a vest conversion of the invention.

As shown in FIG. 1, the article is shown converted into a sleeping bag, whereas in FIG. 3, it is converted into a hooded jump-suit, with gloves and foot warmers. In FIG. 6, the lower half of the sleeping bag is shown converted into the vest, which may be worn either alone, or under the jacket.

In FIG. 5, a modified design of rear panel 50 has double walls 51 and 52, of airtight material, so as to form an inflatable compartment 53 therebetween, so as to serve as an air mattress for greater sleeping comfort, and when used as a garment, provides greater insulation against extreme cold or heat.

Thus a novel sleeping bag, jump-suit, jacket and vest is presented.

While various changes may be made in the detail construction, it is understood that such changes will be within the spirit and scope of the present invention, as is defined by the appended claims.

What I claim is:

1. A sleeping bag, jump-suit, jacket and vest combination article, comprising a front panel, a rear panel attachable to said front panel, a belt, a pair of slip-on gloves and a pair of foot warmers, said front and rear panels comprising a plurality of sheet sections made of suitable fabrics or the like, said sections being selectively attached together for forming either a sleeping bag, a jump-suit, a jacket or a vest; said front panel including an upper section and a lower section, said upper section comprising a right and a left portion each of which is divided into a chest front section and a front jacket arm, a hood at an upper end of said portions, said hood having front sides attachable thereto by zippers, said hood front sides also being secured by zippers to said right and left portions which are separated from each other by a mid-zipper, each of said chest front sections having a pocket closed by a zipper, and also having a swivel strap pivotable for use either as a belt loop or for gathering material for a snug fit, each said chest front section and said front jacket arm integral therewith, having a zipper extending a portion therebetween; said lower section comprising a pair of leg front sections attached together by a zipper therebetween, an outer edge of each said leg front section having a two-way adjustable zipper, a pouch or pocket on each said leg front section closeable by a zipper and each said leg front section additionally including a swivel strap pivotable for use either as a belt loop or for gathering material for a snug fit; said rear panel including an upper section and a pair of leg rear sections attachable by a zipper to a lower edge of said upper section, said upper section having a plurality of buttons for selectively being engaged by said swivel straps of said chest front sections, each said leg rear section having a plurality of buttons for selective engagement with said swivel straps of said leg front sections, an outer edge of each said leg rear section having a zipper for engaging a zipper on the outer edges of said leg front sections; said sleeping bag being formed by said rear panel being aligned behind said front panel, said leg front leg sections being zipped together, said leg rear sections being zipped together, said leg front and rear sections being zipped together along their said outer edges, and said swivel straps engaging said buttons of said rear panel; said jump-suit being formed by said rear panel being aligned behind said front panel, each of said leg front and rear sections being zipped together along the inner and said outer edges thereof, so as to form individual legs, said front jacket arms being unzipped from said chest front sections, said swivel straps being positioned to form loops receiving said belt around said front and rear panels, and said gloves worn on hands and said foot warmers worn on feet of a wearer; said jacket being formed by only an upper portion of said jump-suit by unzipping thereof from said leg front and rear sections; and said vest being formed by said leg front and rear sections zipped together and worn in an inverted position, with said belt being received in loops of said lower section swivel straps.

* * * * *